United States Patent [19]

Takahashi

[11] 4,123,084

[45] Oct. 31, 1978

[54] SKI BOOT TOE BINDING

[75] Inventor: Tohru Takahashi, Tokyo, Japan

[73] Assignee: Hope Co., Ltd., Tokyo, Japan

[21] Appl. No.: 798,484

[22] Filed: May 19, 1977

[51] Int. Cl.[2] ..... A63C 9/08

[52] U.S. Cl. ..... 280/630

[58] Field of Search ..... 280/630, 629

[56] References Cited

U.S. PATENT DOCUMENTS

| | | | |
|---|---|---|---|
| 3,801,120 | 4/1974 | Sittman | 280/630 |
| 3,845,966 | 11/1974 | Ulbrich | 280/630 |
| 3,905,611 | 9/1975 | Sittman | 280/630 |

*Primary Examiner*—Robert R. Song

*Attorney, Agent, or Firm*—Emrich, Root, O'Keeffe & Lee

[57] ABSTRACT

A metallic main body having a toe holder at one end thereof is rotatably mounted upon a base plate by a pivot means provided at one end portion of the main body adjacent to the toe holder. A cam member, against which a roller located at one end of a piston is urged by a horizontally disposed compression spring, is provided separately from the pivot means and projects into an intermediate free space in the main body between the pivot means and the other end of the main body.

4 Claims, 5 Drawing Figures

SKI BOOT TOE BINDING

BACKGROUND OF THE INVENTION

This invention relates to a ski boot toe binding of the type in which a metallic main body having a toe holder at one end thereof is rotatably mounted on a base plate and yieldably supported and held in position thereon by a horizontally disposed compression spring. This spring is provided in a cavity in the main body and urges a piston against a cam member integral with or secured to the base plate.

The ski boot toe binding of this general type is known as shown, for example in U.S. Pat. Nos. 3,027,173 and 3,430,971.

In the toe binding according to U.S. Pat. No. 3,027,173, a pivot pin projects through an elongated vertical opening in a main body and rotatably supports the main body on the base plate. The pivot pin has a flat face on the front side thereof against which the flat end of a piston is urged. Thus, the pivot pin itself also functions as the cam member. In such a known toe binding, when a lateral force is applied to a ski boot toe fitted to this binding, the main body first receives a rotational force tending to rotate it about the pivot pin and presses against the surface of the pin at the end thereof. Accordingly, at the time of rotation of the main body, a relatively high sliding frictional resistance is developed between the main body and the surface of the pivot pin at the end thereof. Thus, the main body has to rotate against the frictional resistance and the force of the piston will be urged against the flat face by the spring. Also, frictional resistance is developed between the main body and the surface of the pivot pin at the end thereof when the main body is displaced to a lateral position short of a toe releasing position and then returns to the normal toe holding position. Therefore, the restitution force of the spring is reduced by the frictional resistance.

The restitution force of the toe binding is such a force as to return or restore the binding from the displaced position short of the toe releasing position to the normal toe holding position. It is said that toe bindings having higher restitution forces are more reliable and safe, since the return of the binding from the displaced position to the normal position is rapid.

In order to provide a higher restitution force to the binding, a spring having higher compression force may be used, but the binding force caused by this spring force results in the frictional resistance also becoming greater. In a toe binding which has to release the boot toe at a predetermined value of the lateral force, it is impossible in practice to increase the spring force in order to obtain a higher restitution force.

In the other known toe binding shown in U.S. Pat. No. 3,430,971, a main body is rotatably mounted on a pivot pin, which in turn is fitted on a base plate and projects through an elongated slot in a piston. The piston is urged by a spring against a cam plate secured on the base plate. In such a toe binding, when the main body receives a lateral force causing it to rotate about the pin, the piston, which rotates together with the main body, is pressed against the pivot pin, thereby producing a sliding frictional resistance therebetween. Thus, the movement of the piston is somewhat interfered with by the frictional resistance with the result that the restitution force of this binding is also reduced as in the case of the known binding shown in U.S. Pat. No. 3,027,173.

Furthermore, in these known toe bindings set forth above or other toe bindings, a ski boot toe holder, which is provided at one end of the main body, is made of metal and formed to receive both front side edges of the boot toe. Accordingly, when the boot toe is displaced toward the toe releasing position by a lateral force applied thereto, a relatively high sliding frictional resistance is developed between the contact surfaces of the front side edge of the boot toe and the metallic toe holder. Such a frictional resistance is also developed when the main body is displaced to a certain position short of reaching the toe releasing position and then returns to the normal position thereof. The reduction of the restitution force of the binding caused by such frictional resistance is something which should not be neglected in a safety binding.

In order to reduce such frictional resistance, it has been proposed to attach thin synthetic resin plates having low coefficient of friction to both inner sides of the metallic toe holder, against which both front side edges of the boot toe will bear. In such case it is necessary to form concave areas at both inner sides of the metallic toe holder to snugly receive the synthetic resin plates therein. However, the synthetic resin plates do not adhere to the metal surface permanently and it has been experienced that they tend to become disengaged and to fall off.

Another proposal which has been made to reduce the frictional resistance between the toe holder and the boot toe is to form the toe holder entirely of synthetic resin having low coefficient of friction. However, when such a toe holder is used together with a heel binding which urges the boot forwardly by a spring force, the toe holder made of synthetic resin is partially deformed by the strong forward pressure of the heel binding due to the elasticity of the resin. Although such deformation of the toe holder is relatively small in the normal toe holding position, it becomes larger as the toe holder is displaced toward the toe releasing position and, therefore, the accuracy of the binding force is somewhat affected. In addition to the above disadvantages, the toe holder made of synthetic resin is relatively fragile when external forces are applied especially at low temperatures.

SUMMARY OF THE INVENTION

Accordingly, an object of the present invention is to provide a ski boot toe binding of simple structure having a high restitution force.

Another object of the present invention is to provide a ski boot toe binding having a high restitution force with reduced frictional resistance between a main body and a pivot means rotatably mounting the main body on a base plate.

Still another object of the present invention is to provide a ski boot toe binding having a high restitution force with reduced frictional resistance between a boot toe holder at one end of a main body and a ski boot toe.

In a ski boot toe binding according to the present invention, a metallic main body has a toe holder at one end thereof and is rotatably mounted upon a base plate by a pivot means provided at said one end portion of the main body adjacent to the toe holder. A cam member is provided separately from the pivot means and projects into an intermediate free space in the main body between the pivot means and the opposite or front end of the main body. A piston urged toward the cam member by a horizontal compression spring has a roller which is pressed against a cam surface of the cam member.

Accordingly, the center of rotation of the main body is at the pivot means connecting the end portion of the main body to the base plate. A lateral force applied to the toe holder causes the main body to rotate whereupon the roller on the end of the piston will roll along the surface of the cam member against the force of the spring. No sliding frictional resistance is produced between the main body and the pivot means and, therefore, the spring force effectively acts upon the main body, with the result that the ski boot toe binding has a high restitution force with a simple structure.

To provide the ski boot toe binding with a higher restitution force, it is preferable to provide a boot toe receiving member at the inner surface of the toe holder. The toe receiving member is made to be vertically adjustable relative to the toe holder. The toe receiving member is made of synthetic resin having a low coefficient of friction, and has vertical thin side walls adapted to contact the front side edges of a ski boot and a transverse horizontal wall adapted to hold the front upper edge of the ski boot. The outer surface of the vertical side walls of the toe receiving member contact the inner surface of the toe holder.

Other objects and features of the present invention will become apparent from the following description of a preferred embodiment thereof taken in conjunction with the accompanying drawings.

DETAILED DESCRIPTION OF THE INVENTION

Figure 1:
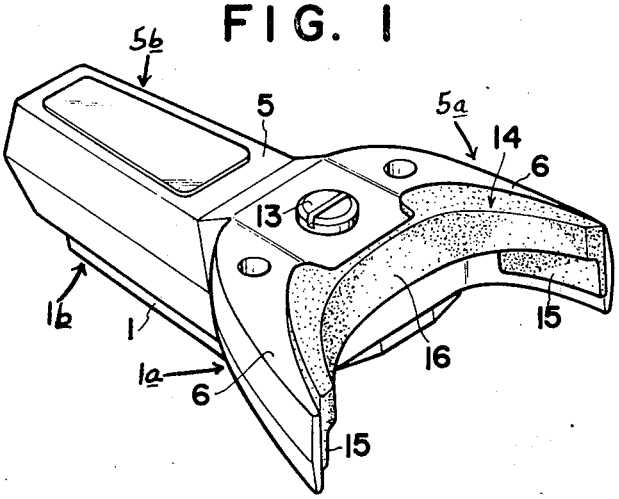
FIG. 1 is a perspective view of a ski boot toe binding according to an embodiment of the present invention.
Figure 2:
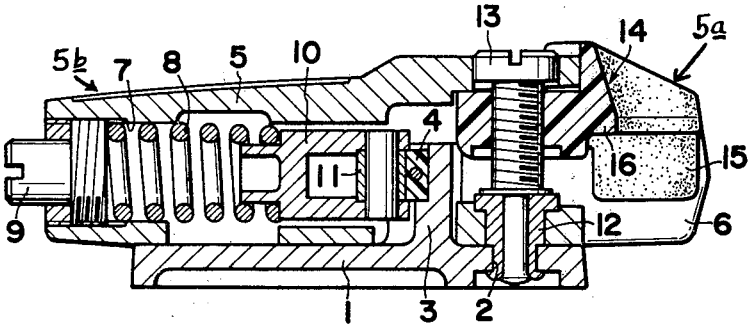
FIG. 2 is a longitudinal vertical sectional view of the toe binding shown in FIG. 1.
Figure 3:
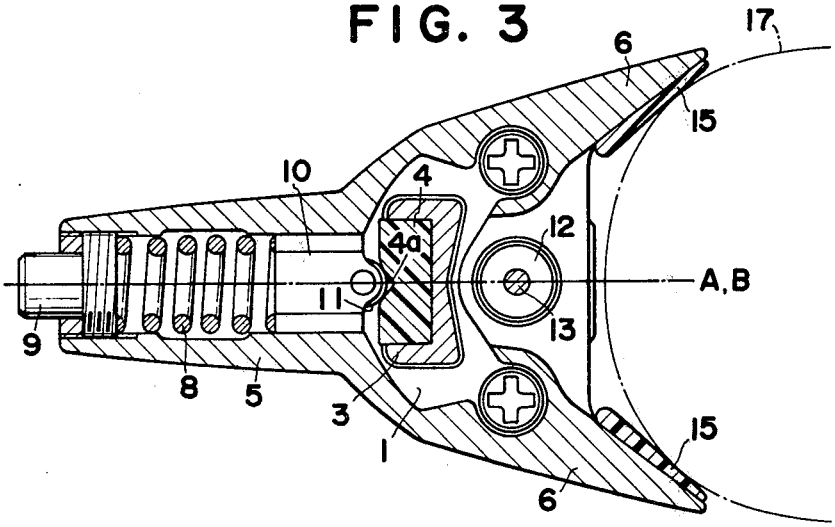
FIG. 3 is a sectional view in a horizontal plane of the same toe binding.

Referring now to the ski boot toe binding shown in FIGS. 1 to 3, a base plate 1 adapted to be attached on the upper surface of a ski has a rear end 1*a* and a front end 1*b* and a hole 2 through the rear (right hand side in the Figures) end 1*a* at the center part thereof. A vertical extension 3 is located adjacent the hole 2 on the side thereof toward the front 1*b* of the base plate. The vertical extension 3 is integrally formed with the base plate 1 and has a cam member 4 attached to the side thereof which is toward the front of the base plate. The cam member 4 is made of hard synthetic resin having a low coefficient of friction and has a concave area 4*a* at the front center thereof which faces the front of the base plate.

Mounted upon the base plate 1 is a pivotably metallic main body 5 which has an arc-shaped toe holder portion 6 formed integral therewith at the rear end 5*a* thereof. The main body 5 has an axially extending elongated bore 7 in the front portion 5*b* thereof in which a compression spring 8 is disposed. The front end of the spring 8 is received by the flange of an adjusting screw 9, while the rear end of the spring 8 acts upon a piston 10 to urge the latter rearwardly. The piston 10 has a roller 11 at the rear end thereof, which is urged against the concave area 4*a* of the cam member 4 by the compression spring 8.

The main body 5 is provided adjacent the rear end 5*a* thereof and at substantially its transverse center with a vertically extending flanged cylindrical member 12, which passes through the hole 2 of the base plate 1 and is calked at the lower end thereof to pivotably connect the main body 5 to the base plate 1. Also provided at the rear center part of the main body 5 and immediately above the member 12 is a vertically extending threaded rod 13, which is threadedly engaged with the boot toe receiving member 14 and has a stem portion extending downwardly through a hole in the cylindrical member 12 which allows it to freely rotate therein. Accordingly, by rotating the vertical threaded rod 13 in the clockwise or counterclockwise direction the toe receiving member 14 can be moved up or down.

The toe receiving member 14 is made of relatively hard synthetic resin having a low coefficient of friction, such as acetal resins, and has vertical side walls 15 and a transversely extending arcuate wall 16 integral with each other as clearly shown in FIGS. 1 and 2. The vertical side walls 15 of the toe receiving member are adapted to contact the side edges of a boot toe 17 in the normal toe holding position as shown in FIG. 3, while the transverse wall 16 thereof is adapted to hold the front upper edge of the boot toe. The contour of the front surface of the toe receiving member 14 corresponds with the contour of the rear inner surface of the toe holder, so that the outer surfaces of the side walls 15 of the toe receiving member 14 contact the inner side walls of the toe holder 6.

Although the toe receiving member 14 shown in the Figures has both of the side walls 15 integral with the transverse wall 16, the toe receiving member may be divided into two parts along the longitudinal center line of the binding. In this case, each of the parts as so divided would have one vertical side wall and a portion of the transverse wall adapted to contact one front side edge of the boot toe and each of the so divided parts could be made to be adjustable in the vertical direction independently of each other by a vertical adjusting screw.

Referring now to the operation of the present toe binding, when the toe binding is at the normal position, the roller 11 at the rear end of the piston 10 is pressed against the concave area 4*a* of the cam member 4 by the compression spring 8, as shown in FIG. 3, and the longitudinal center line "A" of the main body 5 and the longitudinal center line "B" of the base plate 1 will coincide and be in the same vertical plane. In this position, both of the front side edges of the ski boot toe 17 will abut or contact the vertical side walls 15 of the toe receiving member 14, while the front upper center edge of the boot toe 17 is held by the transverse wall 16 partially extending thereover in contact therewith.

Figure 4:
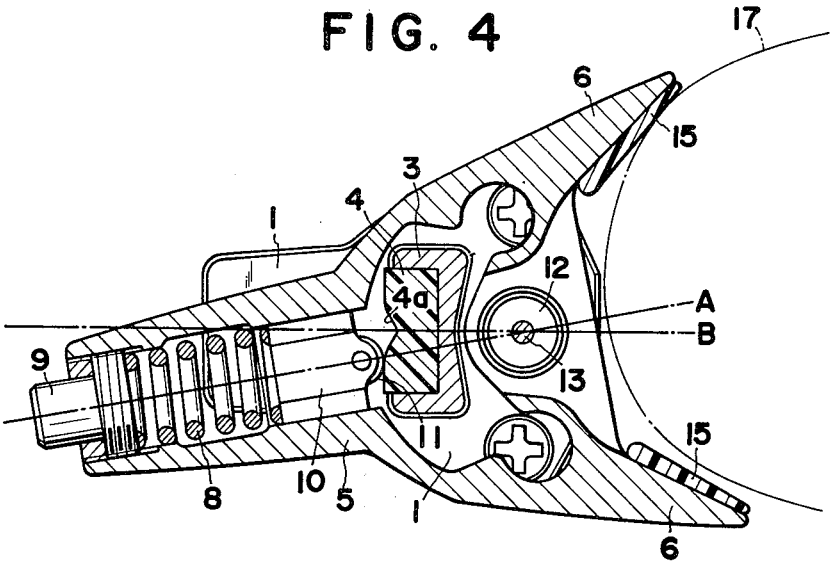
FIG. 4 is a view similar to FIG. 3 in which the main body is partially displaced toward a toe releasing position.
Figure 5:
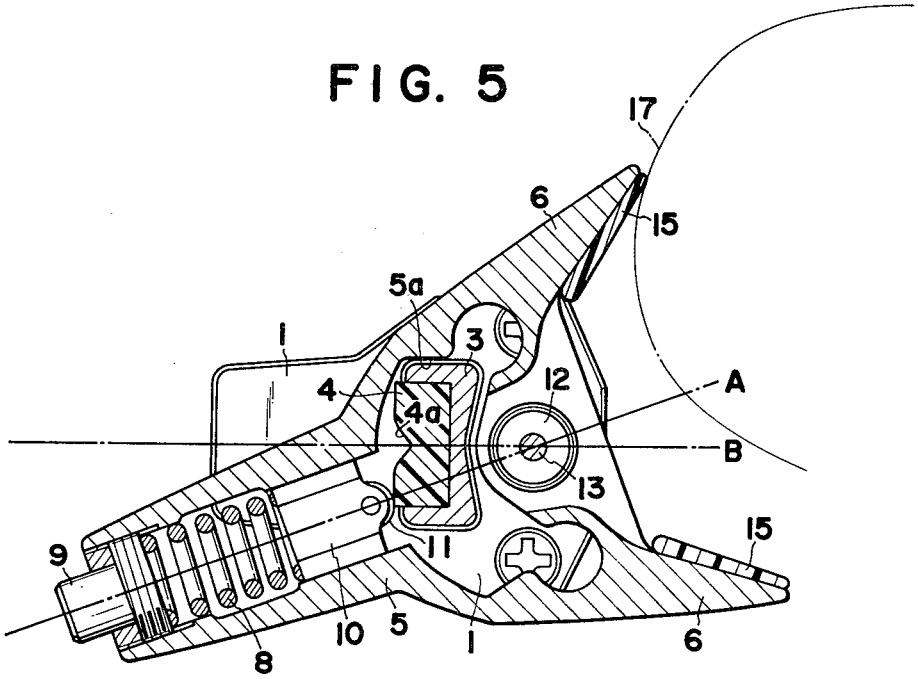
FIG. 5 is a view of the same toe binding similar to FIGS. 3 and 4 in which the main body is displaced to the toe releasing position.

When a lateral force is applied to the boot toe 17, the force is converted into a rotational force tending to rotate the main body 5 about the axis of the threaded rod 13 or that of the cylindrical member 12. However, when the lateral force applied to the boot toe is relatively small, the rotational force of the main body cannot overcome the force of the spring 8 pressing the roller 11 into the center of the concave area 4*a* of the cam member 4, so that the main body will remain in the normal position and the toe receiving member will contact the boot toe. In the event that a relatively strong lateral force is applied to the boot toe and then to the toe holder 6 of the main body 5, the rotational force of the main body 5 overcomes the force of the spring 8, whereby, due to the cam member 4 being attached to the base plate 1 and rigid therewith, the piston 10 will be moved forwardly out of the concave area 4*a* against the compression force of the spring by means of the rolling movement of roller 11 on the cam surface. Thus, the toe binding assumes a partially displaced position as shown in FIG. 4. At this time when the boot toe is displaced to the position shown in FIG. 4 from the normal position shown in FIG. 3, one of the front side edges of the boot toe slides along one of the vertical side walls of the toe receiving member 14 with low frictional resistance. If the lateral force applied to the boot toe is reduced or eliminated while in this position shown in FIG. 4, the main body immediately returns to the normal position and the front side edge of the boot toe contacting the vertical side wall 15 of the toe receiving member 14 slides back to the normal position. In the event that the lateral force applied to the boot toe is strong enough to break a skier's leg, the main body 5 rotates about the axis of the screw rod 13 and is displaced to the toe releasing position shown in FIG. 5. At this toe releasing position, the side surface of the vertical extension 3 on the base plate 1 abuts against the inner wall 5*a* of the main body 5 and restricts the further rotation of the main body, so that the main body 5 can automatically return to the normal position from this toe releasing position after releasing the boot toe therefrom.

As may be understood from the disclosure of the preferred embodiment of the present invention, no sliding frictional resistance is produced about the axis of rotation of the main body when the latter rotates relative to the base plate. The frictional resistance developed between the cam member 11 and the piston 10 is very small, since the piston does not directly contact the cam member 4, and instead, the roller 11 at the end of the piston rolls on the surface of the cam member. Thus, in the relatively simple structure of the present toe binding the sliding frictional resistance is greatly reduced, thereby to effectively transmit the force of the spring as a binding force of the toe binding. Also, such reduction of the frictional resistance serves to greatly increase the restitution force of the spring.

Also, in a preferred structure of the present toe binding, in which the front side edge of the boot toe slides on the vertical wall of the toe receiving member made of synthetic resin having low coefficiency of friction, at the time when the main body, as well as the toe holder, is moved to and from the normal position, the sliding frictional resistance can be minimized and higher restitution force of the binding can be obtained. In addition, as the vertical wall of the toe receiving member is in contact with the toe holder made of metal, the vertical wall can be made very thin without any fear that the wall be broken.

Although the present invention has been described with reference to the preferred embodiment thereof, many modification and alteration may be made within the spirit of the present invention.

What is claimed is:

1. A ski boot toe binding comprising a base plate adapted to be attached on a ski, a metallic main body having a toe holder at one end thereof, a pivot means provided at said one end of said main body adjacent said toe holder for rotatably mounting said main body upon said base plate, a vertical extension on said base plate spaced from said pivot means, a cam member fixed on said extension and having a cam surface thereon on the side thereof facing toward the opposite end of said main body, said cam member being separate from said pivot means and projecting into an opening in said main body between said pivot means and the said opposite end of said main body, a piston within said body member and movable longitudinally thereof, a roller on the end of said piston adjacent said cam surface, and a horizontally disposed compression spring urging said roller against the cam surface of said cam member, whereby a lateral force against the ski boot will rotate said main body toward a toe releasing position, friction will be minimized and restitution forces will be increased.

2. A ski boot toe binding as claimed in claim 1, wherein said cam member is made of synthetic resin having a low coefficient of friction and has a concave area at the center thereof against which said roller is pressed in the normal toe holding position thereof; and said cam member is attached to a vertical extension integral with said base plate.

3. A ski boot toe binding comprising a base plate adapted to be attached on a ski, a metallic main body having a toe holder at one end thereof formed integral therewith, a pivot means provided at said one end of said main body adjacent said toe holder for rotatably mounting said main body upon said base plate, a cam member fixed relative to said base plate and having a cam surface thereon on the side thereof facing toward the opposite end of said main body, said cam member being separate from said pivot means and projecting into an opening in said main body between said pivot means and the said opposite end of said main body, a piston within said main body and movable longitudinally thereof, a roller on the end of said piston adajcent said cam surface, and a horizontally disposed compression spring urging said roller against the cam surface of said cam member, whereby a lateral force against the ski boot will rotate said main body toward a toe releasing position, friction will be minimized and restitution forces will be increased, said toe holder having a toe receiving member vertically adjustable relative thereto and being made of snythetic resin having a low coefficient of friction, said toe receiving member also having vertical thin side walls adapted to contact the front side edges of a ski boot and a horizontal transverse wall adapted to hold the front upper edge of the ski boot, the outer surface of said vertical side walls of said toe receiving member being in contact with the inner surface of said toe holder.

4. A ski boot toe binding as claimed in claim 3, wherein said vertical walls and horizontal transverse wall of said toe receiving member are integrally formed.

* * * * *

UNITED STATES PATENT AND TRADEMARK OFFICE

CERTIFICATE OF CORRECTION

PATENT NO. : 4,123,084

DATED : October 31, 1978

INVENTOR(S) : Tohru Takahashi

It is certified that error appears in the above-identified patent and that said Letters Patent are hereby corrected as shown below:

Col. 3, line59: change "pivotably" to --pivotable--

Signed and Sealed this

*Twenty-seventh* Day of *February 1979*

[SEAL]

*Attest:*

RUTH C. MASON
*Attesting Officer*

DONALD W. BANNER
*Commissioner of Patents and Trademarks*